US006708973B1

(12) United States Patent
Hall, Jr. et al.

(10) Patent No.: US 6,708,973 B1
(45) Date of Patent: Mar. 23, 2004

(54) PUZZLE DEVICE AND METHOD OF USING

(76) Inventors: Edwin A. Hall, Jr., 1513 State Rd. 559 #213, Polk City, FL (US) 33868; Linda Hall, 1513 State Rd. 559 #213, Polk City, FL (US) 33868

( * ) Notice: Subject to any disclaimer, the term of this patent is extended or adjusted under 35 U.S.C. 154(b) by 0 days.

(21) Appl. No.: 10/369,459

(22) Filed: Feb. 20, 2003

(51) Int. Cl.[7] ..... A63F 9/10
(52) U.S. Cl. ..... 273/157 R
(58) Field of Search ..... 273/153 R, 157 R, 273/156

(56) References Cited

U.S. PATENT DOCUMENTS

| | | | | |
|---|---|---|---|---|
| 1,558,165 A | * | 10/1925 | Haswell | 273/156 |
| 3,547,444 A | * | 12/1970 | Williams | 273/157 R |
| D281,791 S | * | 12/1985 | Dobrzynski | 273/157 R |
| 5,301,953 A | * | 4/1994 | Levin | 273/157 R |
| 6,402,151 B1 | * | 6/2002 | Forrester et al. | 273/157 R |

* cited by examiner

*Primary Examiner*—Steven Wong

(57) ABSTRACT

A puzzle device and an associated method of using the device to construct a contiguous packed configuration are disclosed. The device comprises a generally rectangular board and a plurality of geometrically identically identical tiles. The generally rectangular board having a playing surface, in which the board includes a large hexagonal outline embossed on the playing surface of the board in which a plurality of triangles is embossed on the playing surface of the board along the perimeter of the hexagonal outline of the board. Each tile having a generally flattened hexagonal geometry wherein each tile is partitioned into a first, second, third, fourth, fifth and sixth triangular zones, wherein each zone being a different color than any other zone on each tile so that each tile of the plurality of tiles is unique from all other tiles. The contiguous packed configuration is constructed by adjoining together all of the tiles within the hexagonal outline in a manner so that the coloration of all of the triangular zones of each tile matches the coloration of adjacent triangular zones of adjacent tiles and matches the coloration of adjacent triangles in the board. The method of using the device comprises the steps of connecting, obtaining, laying, placing, and scattering.

20 Claims, 4 Drawing Sheets

PUZZLE DEVICE AND METHOD OF USING

FIELD OF THE INVENTION

The present invention relates games, more particularly to a puzzle device and associated method of using the device to construct a contiguous packed configuration puzzle having a hexagonal shape.

DESCRIPTION OF PRIOR ART

Many varieties of puzzle board games exist. Puzzles of a geometric nature have been enjoyed in endless variety for countless years. One popular class of such puzzles consists of those in which a set of separate pieces, each having a substantially planar face and capable of matching or interfitting edge-to-edge with other pieces, must be arranged into some sort of overall whole.

A wide variety of puzzles devices is currently available on the commercial market and an even larger number of these types of devices are known in the art of puzzle devices, for example, the puzzle disclosed by Thurston in U.S. Pat. No. 490,689; the puzzle disclosed by Brown in U.S. Pat. No. 1,532,875; the puzzle disclosed by Haswell in U.S. Pat. No. 1,558,165; the puzzle disclosed by Clark in U.S. Pat. No. 4,410,180; the color match board game disclosed by Rowbal in U.S. Pat. No. 4,463,952; the matching puzzle with multiple solutions disclosed by Vogeler in U.S. Pat. No. 5,692,749; the twelve-sided polygon tile game and method of playing in U.S. Pat. No. 6,402,151; and the combined puzzle and container therefor in U.S. Pat. No. D353,167.

While all of the above-described devices fulfill their respective, particular objectives and requirements, the aforementioned patents do not describe a puzzle device having a generally rectangular board with a hexagonal outline and a plurality of geometrically identically identical tiles, in which each tile is partitioned into a first, second, third, fourth, fifth and sixth triangular zones, wherein each zone has a different color than any other zone on that tile so that each tile of the plurality of tiles is unique from all other tiles. This combination of elements would specifically match the user's particular individual needs of making it possible to construct a contiguous packed configuration from the tiles by adjoining together all of the tiles within the hexagonal outline in a manner that the coloration of all of the triangular zones of each tile matches the coloration of adjacent triangular zones of adjacent tiles and matches the coloration of adjacent triangles in the board. The above-described patents make no provision for a puzzle device having a generally rectangular board with a hexagonal outline and a plurality of geometrically identically identical tiles, in which each tile is partitioned into a first, second, third, fourth, fifth and sixth triangular zones, wherein each zone has a different color than any other zone on that tile so that each tile of the plurality of tiles is unique from all other tiles.

Therefore, a need exists for a new and improved puzzle device having a generally rectangular board with a hexagonal outline and a plurality of geometrically identically identical tiles, in which each tile is partitioned into a first, second, third, fourth, fifth and sixth triangular zones, wherein each zone has a different color than any other zone on that tile so that each tile of the plurality of tiles is unique from all other tiles. In this respect, the puzzle device according to the present invention substantially departs from the conventional concepts and designs of the prior art, and in doing so provides an apparatus primarily developed for the purpose of providing a means for connecting, obtaining, laying, placing, and scattering so that a contiguous packed configuration may be constructed by adjoining together all of the tiles within the hexagonal outline in a manner where the coloration of all of the triangular zones of each tile matches the coloration of adjacent triangular zones of adjacent tiles and matches the coloration of adjacent triangles in the board.

SUMMARY OF THE INVENTION

The present device and method of using, according to the principles of the present invention, overcomes the shortcomings of the prior art by providing a puzzle device and an associated method of using the device are disclosed. The device comprises a generally rectangular board and a plurality of geometrically identically identical tiles. The generally rectangular board having a playing surface, in which the board includes a large hexagonal outline embossed on the playing surface of the board in which a plurality of triangles is embossed on the playing surface of the board along the perimeter of the hexagonal outline of the board. Each tile having a generally flattened hexagonal geometry wherein each tile is partitioned into a first, second, third, fourth, fifth and sixth triangular zones, wherein each zone being a different color than any other zone on each tile so that each tile of the plurality of tiles is unique from all other tiles. The contiguous packed configuration is constructed by adjoining together all of the tiles within the hexagonal outline in a manner so that the coloration of all of the triangular zones of each tile matches the coloration of adjacent triangular zones of adjacent tiles and matches the coloration of adjacent triangles in the board. The method of using the device comprises the steps of connecting, obtaining, laying, placing, and scattering.

In view of the foregoing disadvantages inherent in the known type puzzle devices now present in the prior art, the present invention provides an improved puzzle device, which will be described subsequently in great detail, is to provide a new and improved puzzle device which is not anticipated, rendered obvious, suggested, or even implied by the prior art, either alone or in any combination thereof.

To attain this, the present invention essentially comprises a generally rectangular board and a plurality of geometrically identically identical tiles. The generally rectangular board having a playing surface, in which the board includes a large hexagonal outline embossed on the playing surface of the board in which a plurality of triangles is embossed on the playing surface of the board along the perimeter of the hexagonal outline of the board. Each tile having a generally flattened hexagonal geometry wherein each tile is partitioned into a first, second, third, fourth, fifth and sixth triangular zones, wherein each zone being a different color than any other zone on each tile so that each tile of the plurality of tiles is unique from all other tiles. The contiguous packed configuration is constructed by adjoining together all of the tiles within the hexagonal outline in a manner so that the coloration of all of the triangular zones of each tile matches the coloration of adjacent triangular zones of adjacent tiles and matches the coloration of adjacent triangles in the board.

There has thus been outlined, rather broadly, the more important features of the invention in order that the detailed description thereof that follows may be better understood, and in order that the present contribution of the art may be better appreciated.

The invention may also include cylindrical column attached to each tile. There are of course, additional features of the invention that will be described hereinafter and which will form the subject matter of the claims attached.

Numerous objects, features and advantages of the present invention will be readily apparent to those of ordinary skill in the art upon reading of the following detailed description of presently preferred, but nonetheless illustrative, embodiments of the present invention when taken in conjunction with the accompany drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved puzzle device that has all the advantages of the prior art puzzle device and none of the disadvantages.

It is another object of the present invention to provide a new and improved puzzle device that may be easily and efficiently manufactured and marketed.

An even further object of the present invention is to provide a new and improved puzzle device that has a low cost of manufacture with regard to both materials and labor, and which accordingly is then susceptible of low prices of sale to the consuming public, thereby making such multipurpose storage unit and system economically available to the buying public.

Still another object of the present invention is to provide a new puzzle device that provides in the apparatuses and methods of the prior art some of the advantages thererof, while simultaneously overcoming some of the disadvantages normally associated therewith.

Even still another object of the present invention is to provide a puzzle device having a generally rectangular board with a hexagonal outline and a plurality of geometrically identically identical tiles, in which each tile is partitioned into a first, second, third, fourth, fifth and sixth triangular zones, wherein each zone has a different color than any other zone on that tile so that each tile of the plurality of tiles is unique from all other tiles. This combination of elements makes it possible to construct a contiguous packed configuration from the tiles by adjoining together all of the tiles within the hexagonal outline in a manner that the coloration of all of the triangular zones of each tile matches the coloration of adjacent triangular zones of adjacent tiles and matches the coloration of adjacent triangles in the board.

Lastly, it is an object of the present invention to provide a new and improved method of using comprising the steps of connecting, obtaining, laying, placing, and scattering.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and description matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE PREFERRED EMBODIMENT

Figure 1:
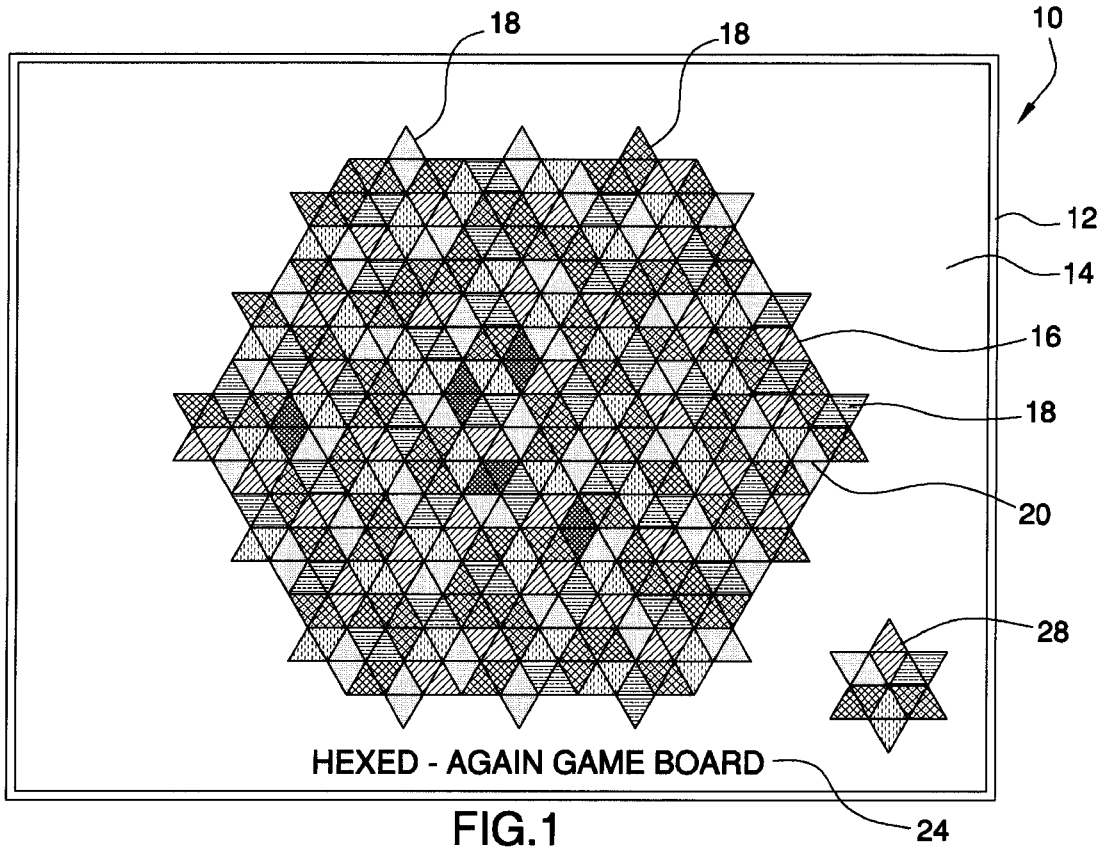
FIG. 1 is a top plan view of a preferred embodiment of the puzzle device having the plurality of tiles positioned within the hexagonal outline as constructed in accordance with the principles of the present invention.

Referring now to the drawings, and in particular FIG. 1 to 4 thereof, one preferred embodiment of the present invention is shown and generally designated by the reference numeral 10. One preferred embodiment of a puzzle device 10 comprises a generally rectangular board 12 and a plurality of geometrically identically identical tiles 20. The generally rectangular board 12 having a playing surface 14, in which the board 12 includes a large hexagonal outline 16 embossed on the playing surface 14 of the board 12; and a plurality of triangles 18 embossed on the playing surface 14 of the board 12, each triangle 18 of the plurality of triangles 18 disposed adjacent to each other in a contiguous manner around the perimeter of the hexagonal outline 16, each triangle 18 having coloration selected from the group consisting of a first color, a second color, a third color, a fourth color, a fifth color, and a sixth color, wherein each triangle 18 of the plurality of triangles 18 having coloration different from coloration of adjacent triangles 18. The plurality of geometrically identically identical tiles 20 having a generally flattened hexagonal geometry, each tile 20 includes a first triangular zone 22, a second triangular zone 22, a third triangular zone 22, a fourth triangular zone 22, a fifth triangular zone 22, and a sixth triangular zone 22. The first triangular zone 22 having coloration from the group consisting of the first color, the second color, the third color, the fourth color, the fifth color, and the sixth color. The second triangular zone 22 has a coloration selected from the group consisting of the first color, the second color, the third color, the fourth color, the fifth color, and the sixth color, in which the coloration of the second triangular zone 22 is different than the coloration of the first triangular zone 22. The third triangular zone 22 has a coloration selected from the group consisting of the first color, the second color, the third color, the fourth color, the fifth color, and the sixth color, in which the coloration of the third triangular zone 22 is different than the coloration of the first and second triangular zones 22. The fourth triangular zone 22 has a coloration selected from the group consisting of the first color, the second color, the third color, the fourth color, the fifth color, and the sixth color, in which the coloration of the fourth triangular zone 22 is different than the coloration of the first, second and third triangular zones 22. The fifth triangular zone 22 has a coloration selected from the group consisting of the first color, the second color, the third color, the fourth color, the fifth color, and the sixth color, in which the coloration of the fifth triangular zone 22 is different than the coloration of the first, second, third, and fourth triangular zones 22. The sixth triangular zone 22 has a coloration selected from the group consisting of the first color, the second color, the third color, the fourth color, the fifth color, and the sixth color, in which the coloration of the sixth triangular zone 22 is different than the coloration of the first, second, third, fourth, and fifth triangular zones 22. Each tile 20 of the plurality of tiles 20 has a color distribution unique to each tile. The plurality of tiles 20 are positionable within the hexagonal outline 16 of the playing surface 14 of the board 12 in a contiguous packed configuration so that the coloration of all of the triangular zones 22 of each tile 20 in the contiguous packed configuration matches the coloration of adjacent triangular zones 22 of adjacent tiles 20 and matches the coloration of adjacent triangles 18.

Optional logo indicia 24 may be embossed on the playing surface 14 of the board 12 in which the logo indicia 24 comprises "HEXED-AGAIN GAME Board 12".

An optional a cylindrical column 26 attached to each tile 20 of the plurality of tiles 20 An optional six pointed star 28 may be embossed on the playing surface 14 of the board 12. One preferred configuration of the six pointed star 28 comprises a second plurality of triangular zones 22 forming the star 28, each triangular zone 22 of the second plurality of triangular zones 22 having coloration selected from the group consisting of the first color, the second color, the third color, the fourth color, the fifth color, and the sixth color. Another preferred configuration of the six pointed star 28 comprises a plurality of interconnected adjacent rhombuses forming the six pointed star 28, each rhombus having coloration selected from the group consisting of the first color, the second color, the third color, the fourth color, the fifth color, and the sixth color.

Another preferred embodiment of the puzzle device 10 consisting essentially of: a generally rectangular board 12 having a playing surface 14, the board 12 including: a large 20 hexagonal outline 16 embossed on the playing surface 14 of the board 12; and a plurality of triangles 18 embossed on the playing surface 14 of the board 12, each triangle 18 of the plurality of triangles 18 disposed adjacent to each other in a contiguous manner around the perimeter of the hexagonal outline 16, each triangle 18 having coloration selected from the group consisting of a first color, a second color, a third color, a fourth color, a fifth color, and a sixth color, wherein each triangle 18 of the plurality of triangles 18 having coloration different from coloration of adjacent triangles 18; and a plurality of geometrically identically identical tiles 20 having a generally flattened hexagonal geometry, each tile 20 including: a first triangular zone 22 having coloration from the group consisting of the first color, the second color, the third color, the fourth color, the fifth color, and the sixth color; a second triangular zone 22 having coloration selected from the group consisting of the first color, the second color, the third color, the fourth color, the fifth color, and the sixth color, the coloration of the second triangular zone 22 is different than the coloration of the first triangular zone 22; a third triangular zone 22 having coloration selected from the group consisting of the first color, the second color, the third color, the fourth color, the fifth color, and the sixth color, the coloration of the third triangular zone 22 is different than the coloration of the first and second triangular zones 22; a fourth triangular zone 22 having coloration selected from the group consisting of the first color, the second color, the third color, the fourth color, the fifth color, and the sixth color, the coloration of the fourth triangular zone 22 is different than the coloration of the first, second and third triangular zones 22; a fifth triangular zone 22 having coloration selected from the group consisting of the first color, the second color, the third color, the fourth color, the fifth color, and the sixth color, the coloration of the fifth triangular zone 22 is different than the coloration of the first, second, third, and fourth triangular zones 22; a sixth triangular zone 22 having coloration selected from the group consisting of the first color, the second color, the third color, the fourth color, the fifth color, and the sixth color, the coloration of the sixth triangular zone 22 is different than the coloration of the first, second, third, fourth, and fifth triangular zones 22; and a cylindrical column 26 attached to each tile 20, wherein each tile 20 of the plurality of tiles 20 having a color distribution unique to each tile, wherein the plurality of tiles 20 are positionable within the hexagonal outline 16 of the playing surface 14 of the board 12 in a contiguous packed configuration so that the coloration of all of the triangular zones 22 of each tile 20 in the contiguous packed configuration matches the coloration of adjacent triangular zones 22 of adjacent tiles 20 and matches the coloration of adjacent triangles 18; a logo indicia 24 embossed on the playing surface 14 of the board 12, wherein the logo indicia 24 comprises "HEXED-AGAIN GAME Board 12"; and a six pointed star 28 embossed on the playing surface 14 of the board 12, wherein the six pointed star 28 comprises a plurality of interconnected adjacent rhombuses forming the six pointed star 28, each rhombus having coloration selected from the group consisting of the first color, the second color, the third color, the fourth color, the fifth color, and the sixth color.

The tiles 20 of the device 10 may be made of any commercially available material. One preferred configuration is that the tiles 20 are made of plastic where the plastic is selected from the group consisting of polyester, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

The number of tiles in the plurality of tiles 20 may be any integer number. One preferred configuration is that the number of the plurality of tiles 20 at least seven tiles 20. Another preferred configuration is that the number of the plurality of tiles 20 at least nineteen tiles 20. Yet another preferred configuration is that the number of the plurality of tiles 20 at least thirty seven tiles 20. Still yet another preferred configuration is that the number of the plurality of tiles 20 at least sixty one tiles 20. A most preferred configuration is that the number of the plurality of tiles 20 comprises sixty two.

The board 12 may be made of any commercially available material. One preferred configuration of the board 12 is that it is made of cardboard 12.

One preferred embodiment of a method of using a puzzle device 10, the method comprising the steps of connecting, obtaining, laying, placing, and scattering. The obtaining step comprises obtaining the device 10 comprising: a generally rectangular board 12 having a playing surface 14, the board 12 including: a large hexagonal outline 16 embossed on the playing surface 14 of the board 12; and a plurality of triangles 18 embossed on the playing surface 14 of the board 12, each triangle 18 of the plurality of triangles 18 disposed adjacent to each other in a contiguous manner around the perimeter of the hexagonal outline 16, each triangle 18 having coloration selected from the group consisting of a first color, a second color, a third color, a fourth color, a fifth color, and a sixth color, wherein each triangle 18 of the plurality of triangles 18 having coloration different from coloration of adjacent triangles 18; and a plurality of geometrically identically identical tiles 20 having a generally flattened hexagonal geometry, each tile 20 including: a first triangular zone 22 having coloration from the group consisting of the first color, the second color, the third color, the fourth color, the fifth color, and the sixth color; a second triangular zone 22 having coloration selected from the group consisting of the first color, the second color, the third color, the fourth color, the fifth color, and the sixth color, the coloration of the second triangular zone 22 is different than the coloration of the first triangular zone 22; a third triangular zone 22 having coloration selected from the group consisting of the first color, the second color, the third color, the fourth color, the fifth color, and the sixth color, the coloration of the third triangular zone 22 is different than the coloration of the first and second triangular zones 22; a fourth triangular zone 22 having coloration selected from the group consisting of the first color, the second color, the third color, the fourth color, the fifth color, and the sixth color, the coloration of the fourth triangular zone 22 is different than the coloration of the first, second and third triangular zones 22; a fifth triangular zone 22 having coloration selected from the group consisting of the first color, the second color, the third color, the fourth color, the fifth color, and the sixth color, the coloration of the fifth triangular zone 22 is different than the coloration of the first, second, third, and fourth triangular zones 22; a sixth triangular zone 22 having coloration selected from the group consisting of the first color, the second color, the third color, the fourth color, the fifth color, and the sixth color, the coloration of the sixth triangular zone 22 is different than the coloration of the first, second, third, fourth and fifth triangular zones 22; a cylindrical column 26 attached to each tile 20, wherein each tile 20 of the plurality of tiles 20 having a color distribution unique to each tile, wherein the plurality of tiles 20 are positionable within the hexagonal outline 16 of the playing surface 14 of the board 12 in a contiguous packed configuration so that the coloration of all of the triangular zones 22 of each tile 20 in the contiguous packed configuration matches the coloration of adjacent triangular zones 22 of adjacent tiles 20 and matches the coloration of adjacent triangles 18; a logo indicia is 24 embossed on the playing surface 14 of the board 12, wherein the logo indicia 24 comprises "HEXED-AGAIN GAME Board 12"; and a six pointed star 28 embossed on the playing surface 14 of the board 12, wherein the six pointed star 28 comprises a plurality of interconnected adjacent rhombuses forming the six pointed star 28, each rhombus having coloration selected from the group consisting of the first color, the second color, the third color, the fourth color, the fifth color, and the sixth color, wherein the number of the plurality of tiles 20 comprises sixty two. The laying step comprises laying the board 12 down onto a level surface so that the playing surface 14 of the board 12 in facing upwards. The placing step comprises placing the plurality of tiles 20 onto a flat surface. The scattering step comprises scattering randomly each tile 20 of the plurality of tiles 20 placed onto the flat surface. The connecting step comprises connecting together each tile 20 of the plurality of tiles 20 within the hexagonal outline 16 of the playing surface 14 of the board 12 into the contiguous packed configuration so that the coloration of all of the triangular zones 22 of each tile 20 in the contiguous packed configuration matches the coloration of adjacent triangular zones 22 of adjacent tiles 20 and matches the coloration of adjacent triangles 18.

Referring now to FIG. 1 which depicts a top plan view of an preferred embodiment of the puzzle device 10 showing the plurality of tiles 20 positioned within the hexagonal outline 16 in the a contiguous packed configuration.

Figure 2:
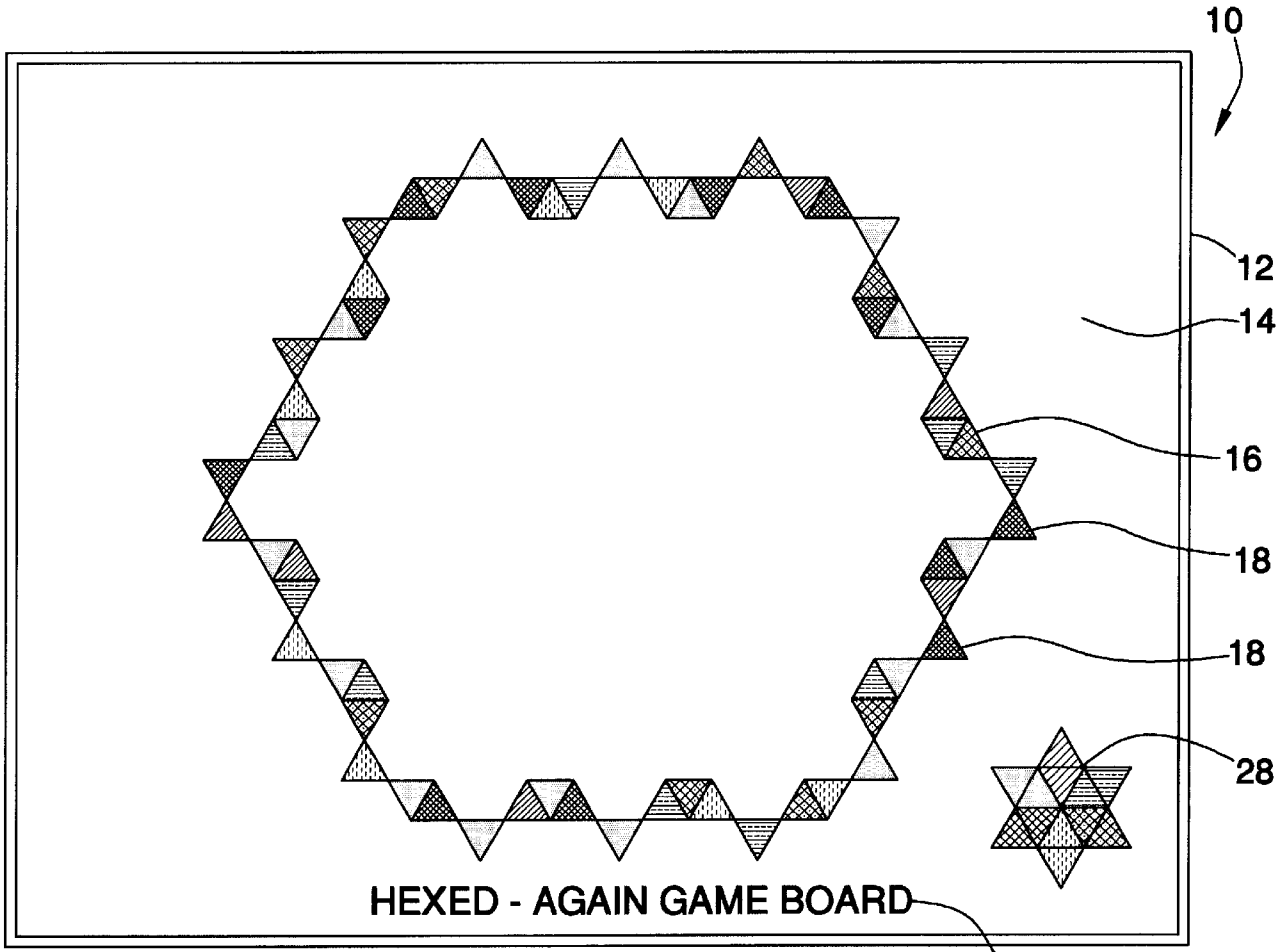
FIG. 2 is a top plan view of a preferred embodiment of the puzzle device showing the hexagonal outline on the board of the present invention.

Referring now to FIG. 2, which depicts a top plan view of a preferred embodiment of the puzzle device 10 having the hexagonal outline 16 on the board 12.

Figure 3:
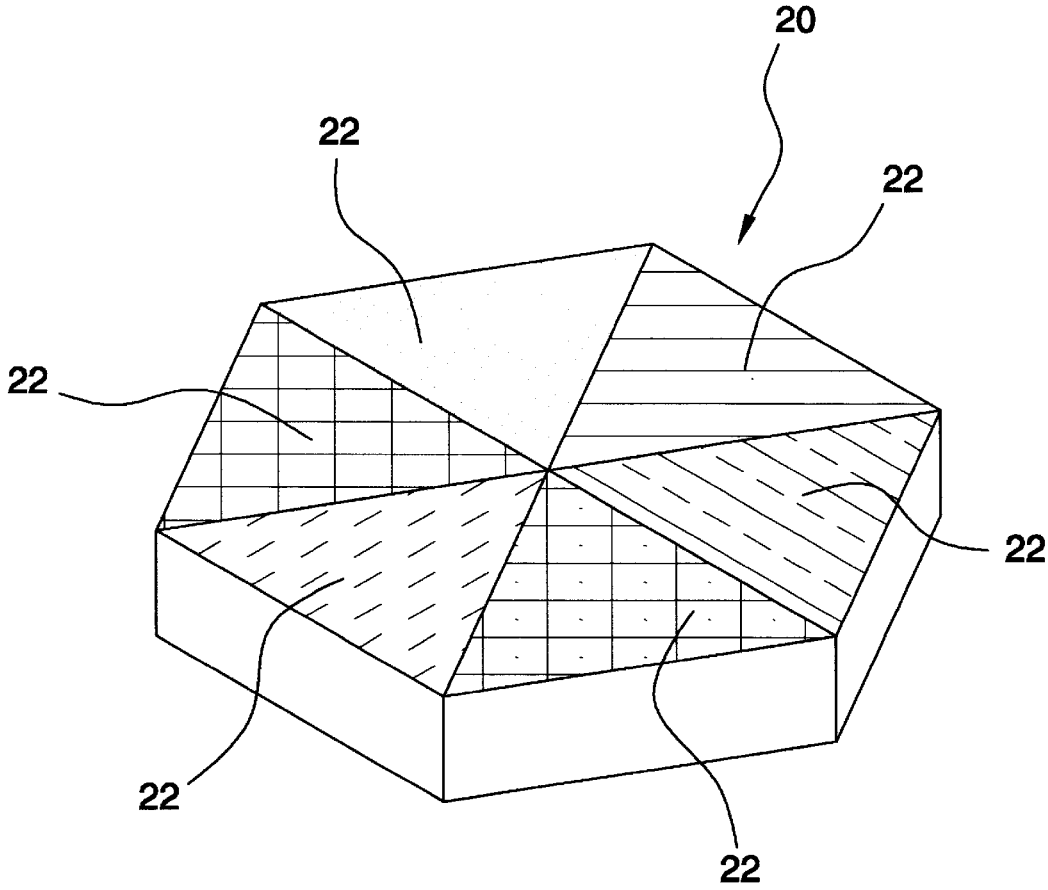
FIG. 3 is a perspective view of a preferred embodiment of a tile of the puzzle device of the present invention.

Referring now to FIG. 3 which depicts a perspective view of a preferred embodiment of a tile 20 of the puzzle device 10 showing the tile 20 having a first triangular zone 22, a second triangular zone 22, a third triangular zone 22, a fourth triangular zone 22, a fifth triangular zone 22, and a sixth triangular zone 22.

Figure 4:
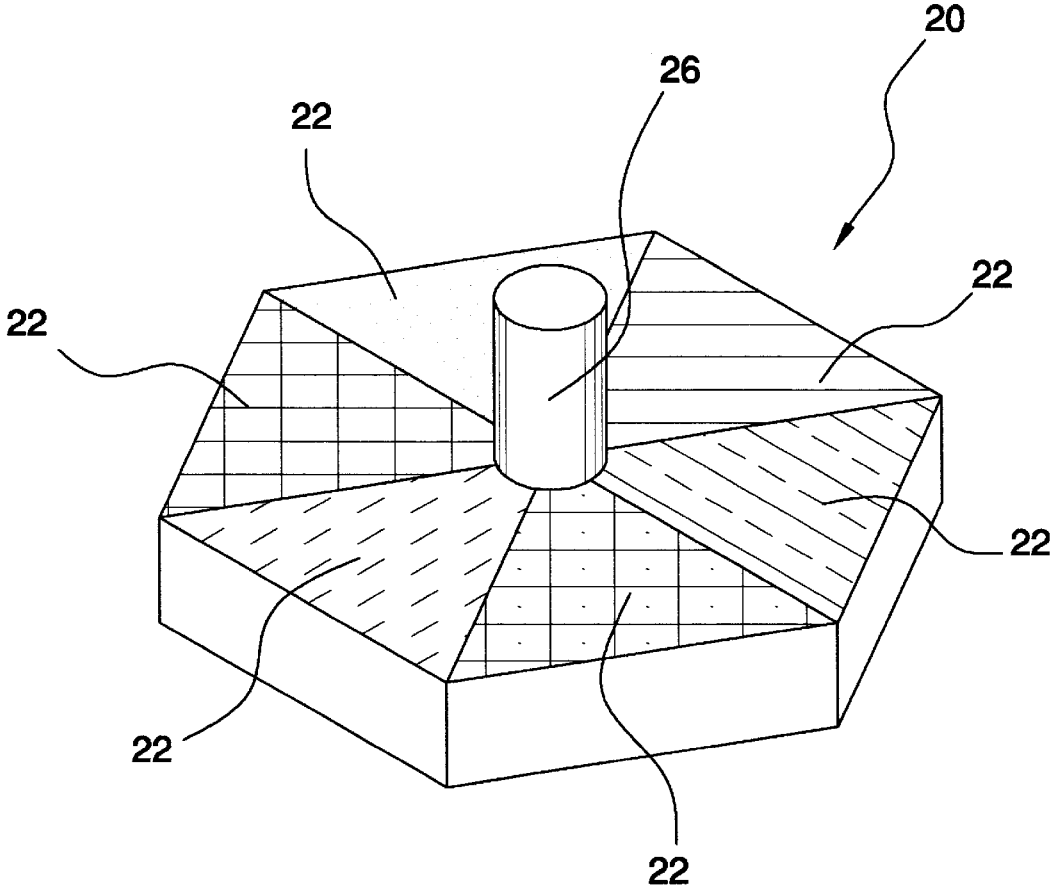
FIG. 4 is a perspective view of a preferred embodiment of a tile of the puzzle device of the present invention.

Referring now to FIG. 4 which depicts a perspective view of a preferred embodiment of a tile of the puzzle device 10 showing the tile 20 having a first triangular zone 22, a second triangular zone 22, a third triangular zone 22, a fourth triangular zone 22, a fifth triangular zone 22, a sixth triangular zone 22, and a cylindrical column.

As to the manner of usage and operation of the present invention, the same should be apparent from the above description. Accordingly, no further discussion relating to the manner of usage and operation will be provided.

While a preferred embodiment of the puzzle device has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Throughout this specification, unless the context requires otherwise, the word "comprise" or variations such as "comprises" or "comprising" or the term "includes" or variations, thereof, or the term "having" or variations, thereof will be understood to imply the inclusion of a stated element or integer or group of elements or integers but not the exclusion of any other element or integer or group of elements or integers. In this regard, in construing the claim scope, an embodiment where one or more features is added to any of the claims is to be regarded as within the scope of the invention given that the essential features of the invention as claimed are included in such an embodiment.

Those skilled in the art will appreciate that the invention described herein is susceptible to variations and modifications other than those specifically described. It is to be understood that the invention includes all such variations and modifications that fall within its spirit and scope. The invention also includes all of the steps, features, compositions and compounds referred to or indicated in this specification, individually or collectively, and any and all combinations of any two or more of said steps or features.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A puzzle device comprising:

a generally rectangular board having a playing surface, said board including:

a large hexagonal outline embossed on said playing surface of said board; and a plurality of triangles embossed on said playing surface of said board, each triangle of said plurality of triangles disposed adjacent to each other in a contiguous manner around the perimeter of said hexagonal outline, each triangle having coloration selected from the group consisting of a first color, a second color, a third color, a fourth color, a fifth color, and a sixth color, wherein each triangle of said plurality of triangles having coloration different from coloration of adjacent triangles; and a plurality of geometrically identically identical tiles having a generally flattened hexagonal geometry, each tile including:

a first triangular zone having coloration from the group consisting of the first color, the second color, the third color, the fourth color, the fifth color, and the sixth color;

a second triangular zone having coloration selected from the group consisting of the first color, the second color, the third color, the fourth color, the fifth color, and the sixth color, the coloration of said second triangular zone is different than the coloration of said first triangular zone;

a third triangular zone having coloration selected from the group consisting of the first color, the second color, the third color, the fourth color, the fifth color, and the sixth color, the coloration of said third triangular zone is different than the coloration of said first and second triangular zones;

a fourth triangular zone having coloration selected from the group consisting of the first color, the second color, the third color, the fourth color, the fifth color, and the sixth color, the coloration of said fourth triangular zone is different than the coloration of said first, second and third triangular zones;

a fifth triangular zone having coloration selected from the group consisting of the first color, the second color, the third color, the fourth color, the fifth color, and the sixth color, the coloration of said fifth triangular zone is different than the coloration of said first, second, third, and fourth triangular zones; and a sixth triangular zone having coloration selected from the group consisting of the first color, the second color, the third color, the fourth color, the fifth color, and the sixth color, the coloration of said sixth triangular zone is different than the coloration of said first, second, third, fourth, and fifth triangular zones, wherein each tile of said plurality of tiles having a color distribution unique to each tile, wherein said plurality of tiles are positionable within said hexagonal outline of said playing surface of said board in a contiguous packed configuration so that the coloration of all of the triangular zones of each tile in said contiguous packed configuration matches the coloration of adjacent triangular zones of adjacent tiles and matches the coloration of adjacent triangles.

2. The device of claim 1 further comprising a logo indicia embossed on said playing surface of said board.

3. The device of claim 2 wherein said logo indicia comprises "HEXED-AGAIN GAME BOARD".

4. The device of claim 1 wherein each tile of said plurality of tiles having a cylindrical column attached to each tile.

5. The device of claim 1 further comprising a six pointed star embossed on said playing surface of said board.

6. The device of claim 5 wherein said six pointed star comprises a second plurality of triangular zones forming said star, each triangular zone of said second plurality of triangular zones having coloration selected from the group consisting of the first color, the second color, the third color, the fourth color, the fifth color, and the sixth color.

7. The device of claim 5 wherein said six pointed star comprises a plurality of interconnected adjacent rhombuses forming said six pointed star, each rhombus having coloration selected from the group consisting of the first color, the second color, the third color, the fourth color, the fifth color, and the sixth color.

8. The device of claim 1 wherein said tiles are made of plastic.

9. The device of claim 8 wherein said plastic is selected from the group consisting of polyester, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

10. The device of claim 1 wherein the number of said plurality of tiles comprises at least seven tiles.

11. The device of claim 1 wherein the number of said plurality of tiles comprises at least nineteen tiles.

12. The device of claim 1 wherein the number of said plurality of tiles comprises at least thirty seven tiles.

13. The device of claim 1 wherein the number of said plurality of tiles comprises at least sixty one tiles.

14. The device of claim 1 wherein the number of said plurality of tiles comprises sixty two.

15. The device of claim 1 wherein said board is made of cardboard.

16. A puzzle device consisting essentially of:

a generally rectangular board having a playing surface, said board including:

a large hexagonal outline embossed on said playing surface of said board; and a plurality of triangles embossed on said playing surface of said board, each triangle of said plurality of triangles disposed adjacent to each other in a contiguous manner around the perimeter of said hexagonal outline, each triangle having coloration selected from the group consisting of a first color, a second color, a third color, a fourth color, a fifth color, and a sixth color, wherein each triangle of said plurality of triangles having coloration different from coloration of adjacent triangles; and a plurality of geometrically identically identical tiles having a generally flattened hexagonal geometry, each tile including:

a first triangular zone having coloration from the group consisting of the first color, the second color, the third color, the fourth color, the fifth color, and the sixth color;

a second triangular zone having coloration selected from the group consisting of the first color, the second color, the third color, the fourth color, the fifth color, and the sixth color, the coloration of said second triangular zone is different than the coloration of said first triangular zone;

a third triangular zone having coloration selected from the group consisting of the first color, the second color, the third color, the fourth color, the fifth color, and the sixth color, the coloration of said third triangular zone is different than the coloration of said first and second triangular zones;

a fourth triangular zone having coloration selected from the group consisting of the first color, the second color, the third color, the fourth color, the fifth color, and the sixth color, the coloration of said fourth triangular zone is different than the coloration of said first, second and third triangular zones;

a fifth triangular zone having coloration selected from the group consisting of the first color, the second color, the third color, the fourth color, the fifth color, and the sixth color, the coloration of said fifth triangular zone is different than the coloration of said first, second, third, and fourth triangular zones;

a sixth triangular zone having coloration selected from the group consisting of the first color, the second color, the third color, the fourth color, the fifth color, and the sixth color, the coloration of said sixth triangular zone is different than the coloration of said first, second, third, fourth, and fifth triangular zones; and a cylindrical column attached to each tile, wherein each tile of said plurality of tiles having a color distribution unique to each tile, wherein said plurality of tiles are positionable within said hexagonal outline of said playing surface of said board in a contiguous packed configuration so that the coloration of all of the triangular zones of each tile in said contiguous packed configuration matches the coloration of adjacent triangular zones of adjacent tiles and matches the coloration of adjacent triangles;

a logo indicia embossed on said playing surface of said board, wherein said logo indicia comprises "HEXED-AGAIN GAME BOARD"; and a six pointed star embossed on said playing surface of said board, wherein said six pointed star comprises a plurality of interconnected adjacent rhombuses forming said six pointed star, each rhombus having coloration selected from the group consisting of the first color, the second color, the third color, the fourth color, the fifth color, and the sixth color.

17. The device of claim 16 wherein said tiles are made of plastic.

18. The device of claim 17 wherein said plastic is selected from the group consisting of polyester, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

19. The device of claim 16 wherein the number of said plurality of tiles comprises sixty two.

20. A method of using a puzzle device, said method comprising the steps of:

obtaining the device comprising:

a generally rectangular board having a playing surface, the board including:

a large hexagonal outline embossed on the playing surface of the board; and a plurality of triangles embossed on the playing surface of the board, each triangle of the plurality of triangles disposed adjacent to each other in a contiguous manner around the perimeter of the hexagonal outline, each triangle having coloration selected from the group consisting of a first color, a second color, a third color, a fourth color, a fifth color, and a sixth color, wherein each triangle of the plurality of triangles having coloration different from coloration of adjacent triangles; and a plurality of geometrically identically identical tiles having a generally flattened hexagonal geometry, each tile including:

a first triangular zone having coloration from the group consisting of the first color, the second color, the third color, the fourth color, the fifth color, and the sixth color;

a second triangular zone having coloration selected from the group consisting of the first color, the second color, the third color, the fourth color, the fifth color, and the sixth color, the coloration of the second triangular zone is different than the coloration of the first triangular zone;

a third triangular zone having coloration selected from the group consisting of the first color, the second color, the third color, the fourth color, the fifth color, and the sixth color, the coloration of the third triangular zone is different than the coloration of the first and second triangular zones;

a fourth triangular zone having coloration selected from the group consisting of the first color, the second color, the third color, the fourth color, the fifth color, and the sixth color, the coloration of the fourth triangular zone is different than the coloration of the first, second and third triangular zones;

a fifth triangular zone having coloration selected from the group consisting of the first color, the second color, the third color, the fourth color, the fifth color, and the sixth color, the coloration of the fifth triangular zone is different than the coloration of the first, second, third, and fourth triangular zones;

a sixth triangular zone having coloration selected from the group consisting of the first color, the second color, the third color, the fourth color, the fifth color, and the sixth color, the coloration of the sixth triangular zone is different than the coloration of the first, second, third, fourth, and fifth triangular zones; and a cylindrical column attached to each tile, wherein each tile of the plurality of tiles having a color distribution unique to each tile, wherein the plurality of tiles are positionable within the hexagonal outline of the playing surface of the board in a contiguous packed configuration so that the coloration of all of the triangular zones of each tile in the contiguous packed configuration matches the coloration of adjacent triangular zones of adjacent tiles and matches the coloration of adjacent triangles;

a logo indicia embossed on the playing surface of the board, wherein the logo indicia comprises "HEXED-AGAIN GAME BOARD"; and a six pointed star embossed on the playing surface of the board, wherein the six pointed star comprises a plurality of interconnected adjacent rhombuses forming the six pointed star, each rhombus having coloration selected from the group consisting of the first color, the second color, the third color, the fourth color, the fifth color, and the sixth color, wherein the number of the plurality of tiles comprises sixty two;

laying the board down onto a level surface so that the playing surface of the board in facing upwards;

placing the plurality of tiles onto a flat surface;

scattering randomly each tile of said plurality of tiles placed onto the flat surface; and connecting together each tile of the plurality of tiles within the hexagonal outline of the playing surface of the board into the contiguous packed configuration so that the coloration of all of the triangular zones of each tile in the contiguous packed configuration matches the coloration of adjacent triangular zones of adjacent tiles and matches the coloration of adjacent triangles.

* * * * *